US010934720B1

(12) United States Patent
Allen

(10) Patent No.: US 10,934,720 B1
(45) Date of Patent: Mar. 2, 2021

(54) HOUSING FOR ALUMINUM EXTRUDED FRAMING WITH A SPLINE GROOVE

(71) Applicant: RON-L-ALUMINUM INC., Dover, FL (US)

(72) Inventor: Ronald Allen, Dover, FL (US)

( * ) Notice: Subject to any disclaimer, the term of this patent is extended or adjusted under 35 U.S.C. 154(b) by 0 days.

(21) Appl. No.: 16/539,973

(22) Filed: Aug. 13, 2019

(51) Int. Cl.
*E04F 13/21* (2006.01)

(52) U.S. Cl.
CPC ..... *E04F 13/21* (2013.01); *E04F 2201/01* (2013.01)

(58) Field of Classification Search
CPC ... E04F 13/0801; E04F 13/21; E04F 2201/01; E04B 1/0046; E04C 2003/0473
See application file for complete search history.

(56) References Cited

U.S. PATENT DOCUMENTS 3,143,165 A * 8/1964 Lewis ..... E04B 1/0046 160/394
3,382,639 A * 5/1968 Smith ..... E06B 9/52 52/844
4,188,764 A * 2/1980 Gode ..... E04H 15/02 52/481.2
6,385,941 B1 * 5/2002 Power, Jr. ..... E04C 3/06 160/392
6,430,888 B1 * 8/2002 Dombchik ..... E04C 3/06 52/653.1
6,668,495 B1 * 12/2003 Prince ..... E04C 3/06 160/391
8,756,900 B1 * 6/2014 Hudson ..... E04C 3/07 52/844
9,163,454 B1 * 10/2015 Hopson ..... E06B 9/52
2006/0248818 A1 * 11/2006 Buchanan ..... E04B 1/0046 52/200
2007/0294980 A1 * 12/2007 Coley ..... B44C 1/18 52/745.19
2018/0202157 A1 * 7/2018 Neal ..... E04B 9/30

* cited by examiner

*Primary Examiner* — Christine T Cajilig
(74) *Attorney, Agent, or Firm* — Tiffany C. Miller; Inventions International Inc.

(57) ABSTRACT

A housing barrier for concealing fasteners of an aluminum extruded framing with spline groove. A housing is configured to connect to an extruded framing with spline groove. The housing has a first wall, a second wall, and a third wall. The first wall is connected to the second wall. The second wall is connected to the third wall. The first wall and the third wall of the housing are oriented in a parallel orientation forming a u-shaped compartment. At least one wall has a spline groove and a protrusion. The spline groove is located on an outer side of the wall and the protrusion is located on an inner side of the wall. The protrusion is located on an opposite side of the wall having the spline groove of the housing. The protrusion is configured to interlock with the spline groove of the extruded framing.

1 Claim, 8 Drawing Sheets

HOUSING FOR ALUMINUM EXTRUDED FRAMING WITH A SPLINE GROOVE

BACKGROUND OF THE INVENTION

1. Field of the Invention

This invention relates, generally, to aluminum screened-in porch extrusion parts. More particularly, it relates to a cosmetic housing positioned over at least a portion of an aluminum extruded framing, the housing for covering aluminum extruded framing with a spline groove has a protrusion capable of interlocking with the spline groove of aluminum extruded framing.

2. Background Art

Currently, pool and patio screen enclosures can eliminate some maintenance such as keeping bugs and insects out of an area to make swimming more enjoyable. Many of these screen rooms and pool cages utilize aluminum screened-in porch extrusion parts such as a 1×2 track anchored by fasteners such as screws. For example, a 1×2 aluminum extruded framing with spline groove located on the 1" side is capable of framing screen enclosure openings and fastens onto existing wood or concrete structures of a patio with screws. This 1×2 aluminum extruded framing with spline groove accepts flat spline for screen retention. A problem with the current 1×2 aluminum extruded framing with spline groove is that the fasteners or screws are exposed after installation. When the screws are exposed after installation, they can be unsightly to a user, as they are esthetically unappealing. It would be more desirable if the screws were covered by a cosmetic cap so that a pool and patio screen enclosure can have a more enhanced beauty, a cleaner look, and a more seamless feel.

Additionally, when the screws anchoring the 1×2 aluminum extruded framing to a patio are exposed to the elements such as rain, humidity, or snow, they may oxidize and rust. When the fasteners including, but not limited to, screws with washers, begin to oxidize or rust they lose their structural integrity and require additional maintenance to be replaced, which can be costly. Thus, there is a need for a protective housing to be positioned over and connect to the aluminum extruded framing. This would provide a barrier layer between harsh environmental elements such as rain and the fasteners of the aluminum extruded framing. As a result, the lifespan of the installed fasteners of the aluminum extruded framing would be lengthened and eliminate frequent replacement maintenance.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a housing barrier for concealing fasteners of an aluminum extruded framing with spline groove. A housing is configured to connect to an extruded framing with spline groove. The housing has a first wall. The first wall has a first outer side located opposite a second inner side. The housing has a second wall. The second wall has a third outer side located opposite a fourth inner side. The housing has a third wall. The third wall has a fifth outer side located opposite a sixth inner side. The first wall is connected to the second wall. The second wall is connected to the third wall. The first wall and the third wall of the housing are oriented in a parallel orientation forming a u-shaped compartment. At least one wall of the first wall, the second wall, or the third wall has a spline groove and a protrusion. The spline groove is located on an outer side of at least one wall of the first wall, the second wall, or the third wall. The protrusion is located on an inner side of the same wall. The protrusion is located on an opposite side of the wall having the spline groove of the housing. The protrusion is configured to interlock with the spline groove of the extruded framing installed onto the patio or deck surface.

In another embodiment, the novel housing is connected to an extruded framing with a spline groove.

In another embodiment, the protrusion has a radial end. The radial end interlocks with the spline groove of the extruded framing.

In a preferred embodiment, the spline groove of the housing is located above the protrusion of the housing.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
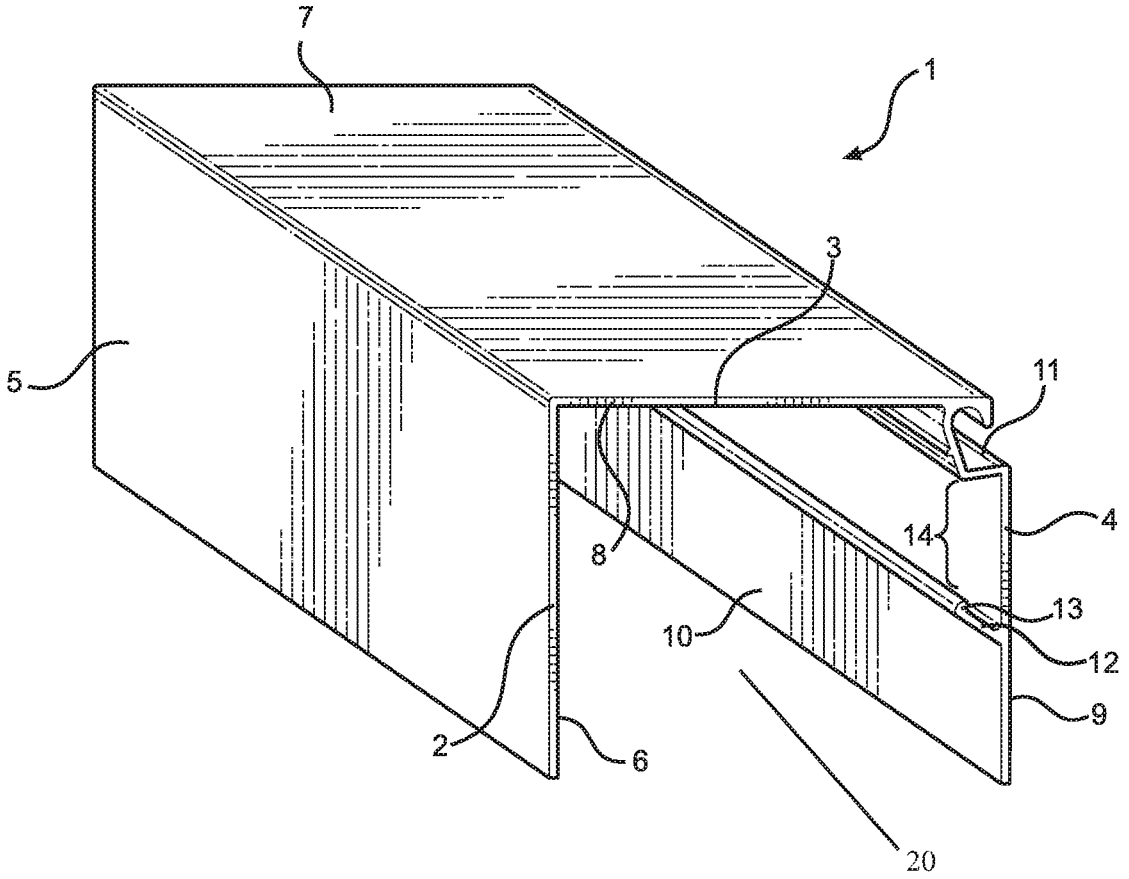
FIG. 1 is a perspective front view of the novel housing for concealing fasteners of an aluminum extruded framing.
Figure 2:
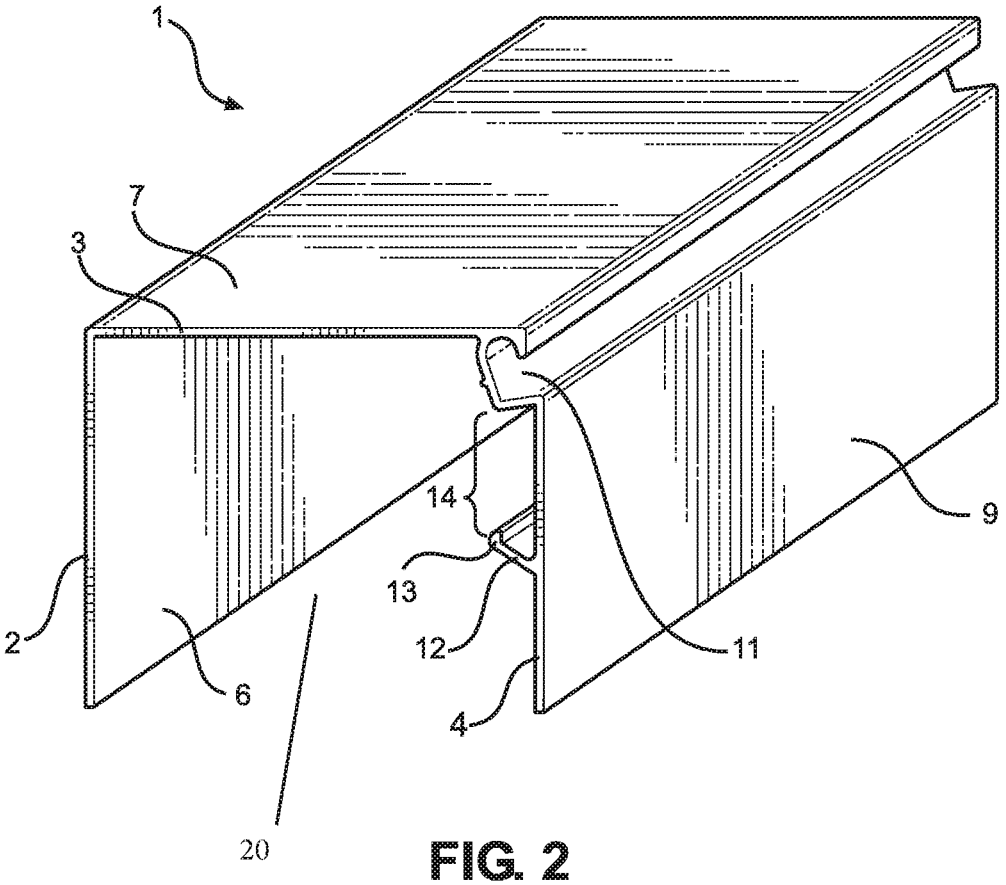
FIG. 2 is a perspective side view of the novel housing for concealing fasteners of an aluminum extruded framing.
Figure 5A:
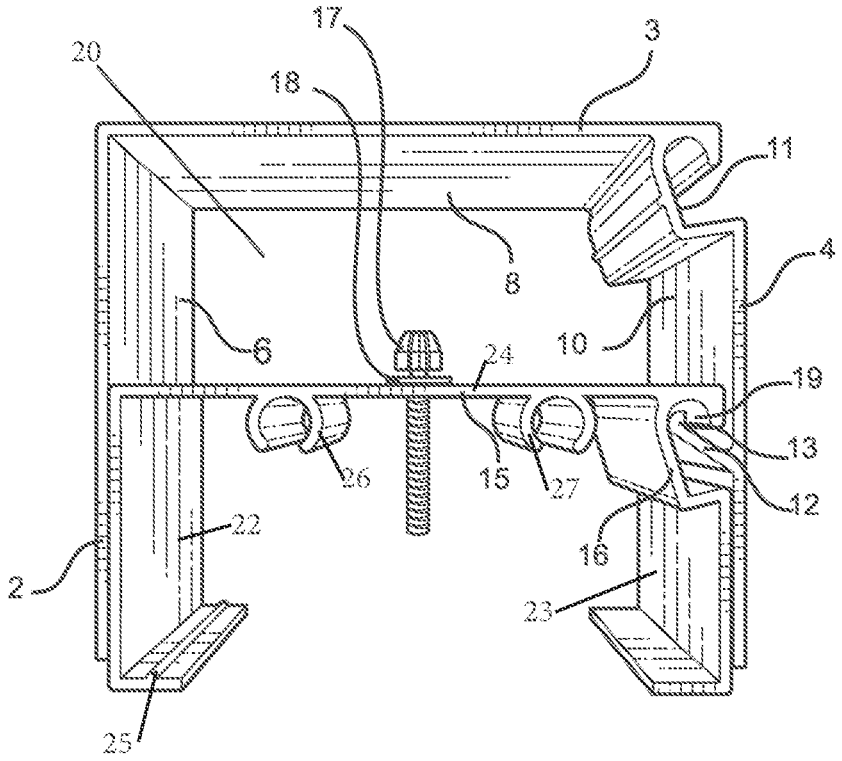
FIG. 5A is a front cut-away view of the housing having a protrusion positioned over a fastener of an extruded framing and interlocking with the spline groove of an extruded framing.
Figure 5B:
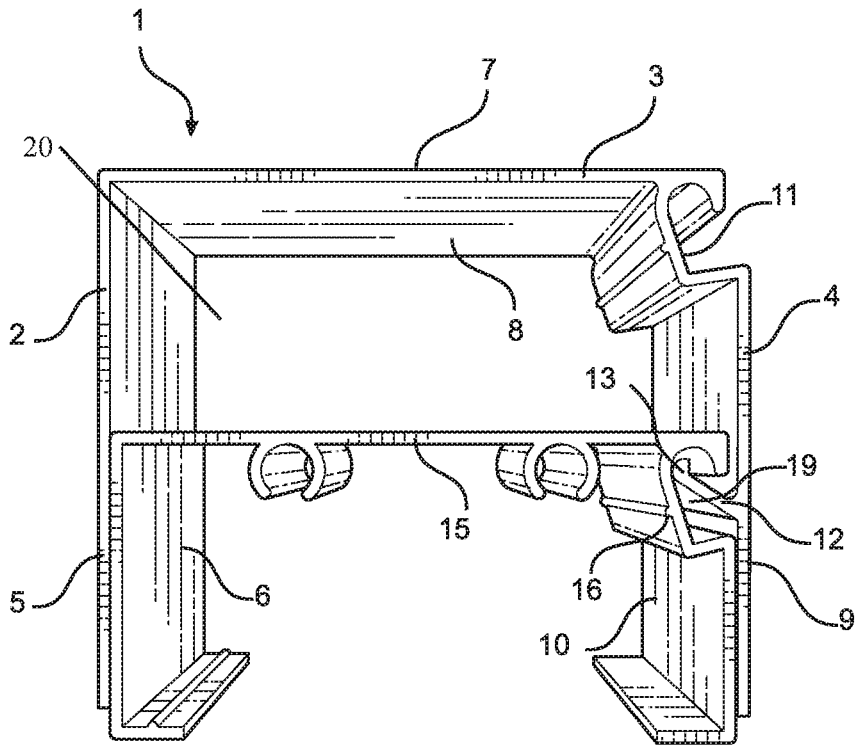
FIG. 5B is a front cut-away view of the housing having a protrusion interlocking with the spline groove of an extruded framing.
Figure 6A:
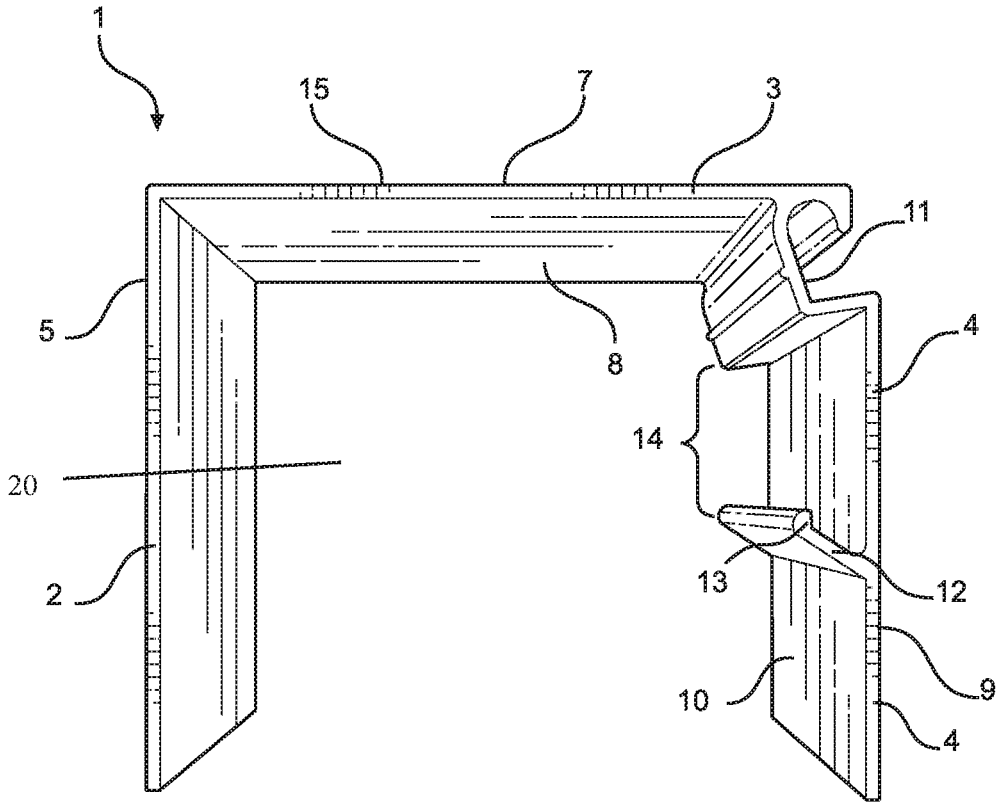
FIG. 6A is a front view of the novel housing.
Figure 6B:
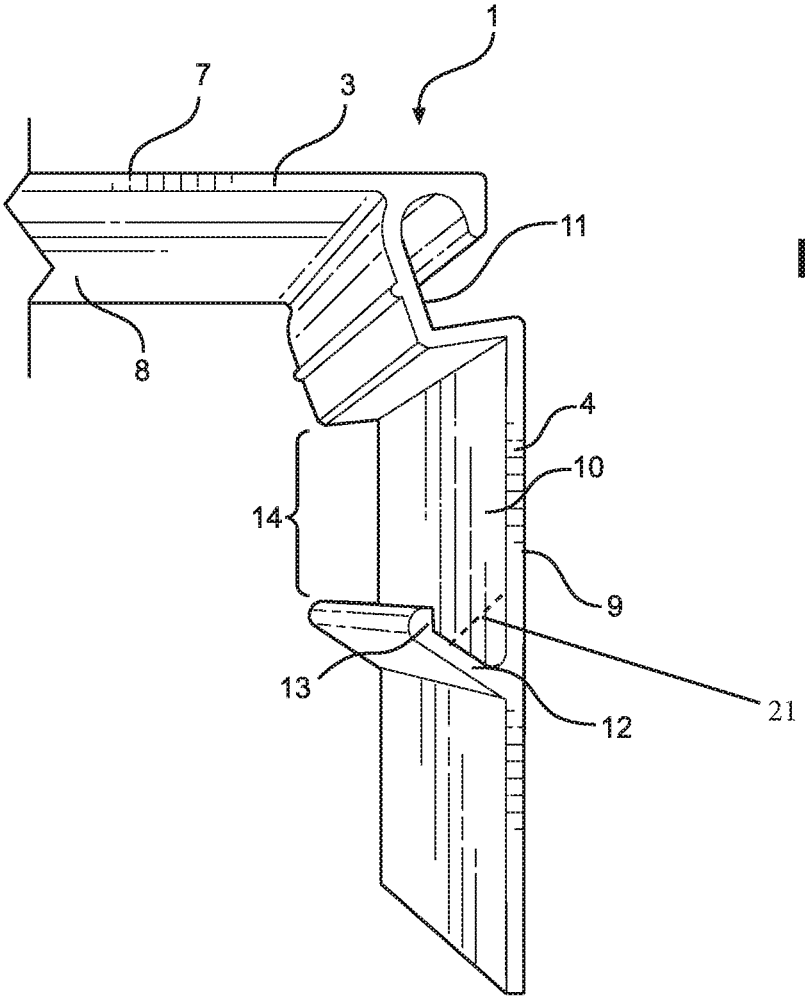
FIG. 6B is a partial view of FIG. 6A illustrating the spline groove and protrusion having a radial end of the housing.

It will now be seen, referring to FIGS. 1, 2, and 6A the novel housing 1 includes a U-shaped aluminum extruded cosmetic barrier made of three walls. First wall 2 of housing 1 has first outer side 5 (FIG. 1) located opposite a second inner side 6. Housing 1 has second wall 3. Second wall 3 has third outer side 7 located opposite fourth inner side 8 (FIGS. 1 and 6B). Housing 1 has third wall 4. Third wall 4 has a fifth outer side 9 located opposite sixth inner side 10 (FIG. 1). First wall 2 is connected to second wall 3. Second wall 3 is connected to third wall 4. First wall 2 and third wall 4 of housing 1 are oriented in a parallel orientation forming u-shaped compartment 20. At least one wall of first wall 2, second wall 3, or third wall 4 have both spline groove 11 and protrusion 12. In FIGS. 1-6B, the at least one wall having both spline groove 11 and protrusion 12 is third wall 4. Spline groove 11 is located on fifth outer side 9 of third wall 4. Spline groove 11 is configured to receive new screen installation (not shown). Protrusion 12 is located sixth inner side 10 of third wall 4. Although protrusion 12 is located on an opposite side of third wall 4 having spline groove 11, spline groove 11 of housing 1 is located above 14 protrusion 12. Protrusion 12 has radial end portion 13. It is important to note that spline groove 11 of housing 1 abuts second wall 3 of housing 1. In particular, at least a portion of spline groove 11 of housing 1 abuts fourth inner side 8 of second wall 3. Referring now to FIG. 5A, extruded framing 15 has top wall 24 connected to first L-shaped portion 22 and second L-shaped portion 23. Top wall 24 of extruded framing 15 has first radial channel 26 and second radial channel 27 both protruding from a surface of top wall 24. Top wall 24 of extruded framing 15 is connected to at least one fastener 17 and washer 18. FIG. 5A further shows at least one fastener 17 and washer 18 are located between first radial channel 26 and second radial channel 27. First L-shaped portion 22 of extruded framing 15 has guide ramp 25. Second L-shaped portion 23 of extruded framing 15 has spline groove 16.

Figure 3:
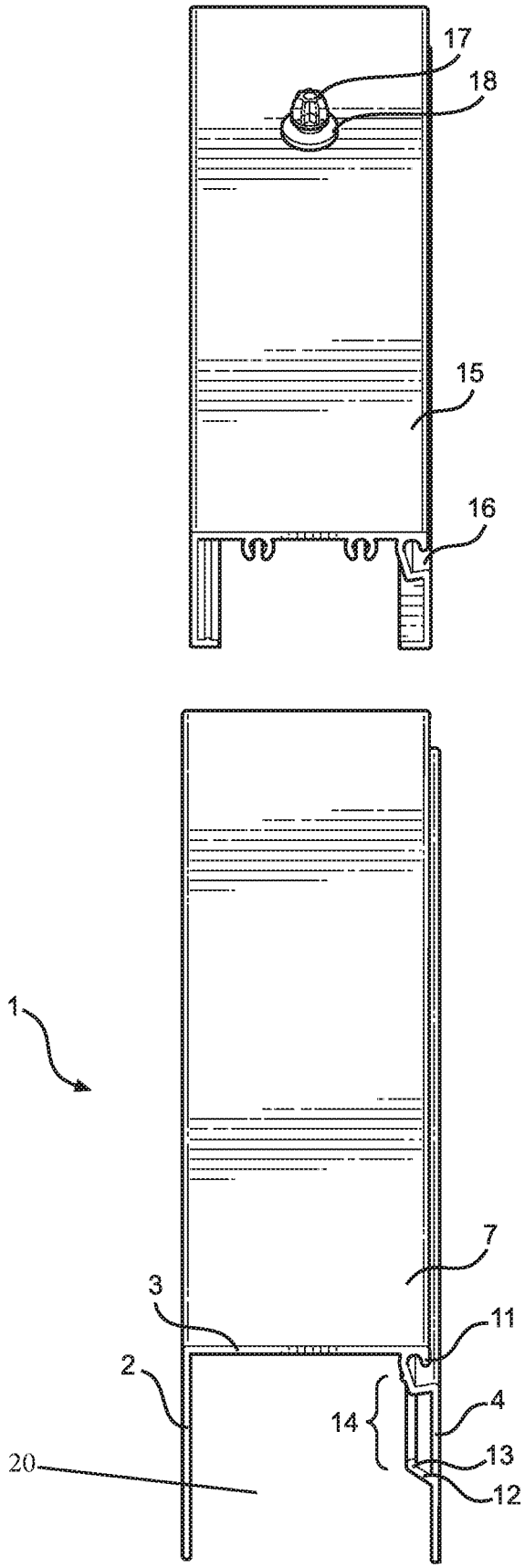
FIG. 3 is an exploded top view of the novel housing and extruded framing with a spline groove and a fastener.
Figure 4:
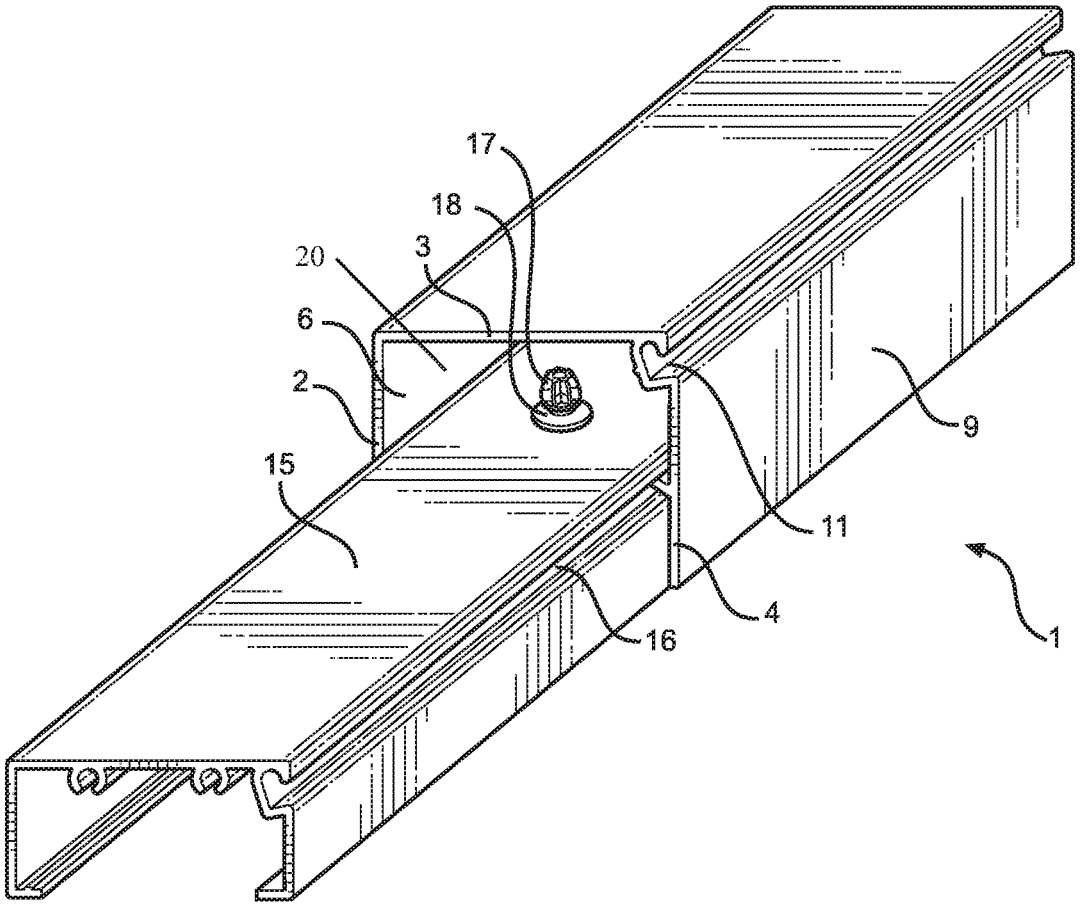
FIG. 4 is a cut away view of the housing having a protrusion interlocking with the spline groove of an extruded framing.

FIGS. 3, 4, and 5A illustrate aluminum extruded framing 15 having a fastener 17. Fastener 17 includes, but is not limited to, a screw. Washer 18 and fastener 17 anchor aluminum extruded framing 15 to a flat surface (not shown) such as a patio or a deck. Aluminum extruded framing 15 has spline groove 16. Although it is within the scope of this invention for extruded framing to be made of aluminum, any material may be used. Protrusion 12 of housing 1 has radial end portion 13 (FIGS. 3, 5A, and 5B) configured to interlock with spline groove 16 of extruded framing 15. Housing 1 has first wall 2 connected to second wall 3. Housing 1 has second wall 3 connected to third wall 4. First wall 2 and third wall 4 of housing 1 are oriented in a parallel orientation forming u-shaped compartment 20. Spline groove 11 of housing 1 is located above 14 (FIG. 3) protrusion 12. Protrusion 12 has radial end portion 13 (FIG. 3).

FIGS. 5A and 5B depict protrusion 12 of housing 1 is captured 19 by spline groove 16 of extruded framing 15. It is an important aspect of this current invention for protrusion 12 to be angled 21 on sixth inner side 10 of third wall 4 at a range between 5 degrees and 85 degrees to engage and interlock with spline grove 16 of extruded framing 15. In a preferred embodiment, angle 21 (FIG. 6B) of protrusion 12 is approximately 40 degrees. When housing 1 is installed and snapped onto extruded framing 15, extruded framing 15 along with fastener 17 and washer 18 are retained within compartment 20 of housing 1. Compartment 20 is great enough in size to retain extruded framing 15 and fastener 17.

FIG. 6B shows housing 1 having second wall 3 being connected to third wall 4. Third wall 4 has a fifth outer side 9 located opposite sixth inner side. Second wall 3 is connected to third wall 4. Spline groove 11 is located on fifth outer side 9 of third wall 4. FIG. 6B illustrates protrusion 12 being located on sixth inner side 10 of third wall 4. Although protrusion 12 is located on an opposite side of third wall 4 having spline groove 11 opening, spline groove 11 of housing 1 is located above 14 protrusion 12. The opening of spline groove 11 of housing 1 borders fifth outer side 9 of third wall 4 of housing 1. Protrusion 12 has radial end portion 13. Spline groove 11 of housing 1 abuts second wall 3 of housing 1. In particular, at least a portion of spline groove 11 of housing 1 abuts fourth inner side 8 of second wall 2.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

The invention claimed is:

1. A housing configured to connect to an extruded framing with spline groove, comprising:

a housing, said housing is connected to an extruded framing, said extruded framing having a top wall connected to a first L-shaped portion and a second L-shaped portion, said top wall of said extruded framing having a first radial channel and a second radial channel both protruding from a surface of said top wall, said top wall of said extruded framing is connected to at least one fastener and a washer, said at least one fastener and said washer are located between said first radial channel and said second radial channel, said first L-shaped portion of said extruded framing having a guide ramp, said second L-shaped portion of said extruded framing having a spline groove, said housing is positioned over said at least one fastener of said extruded framing;

said housing comprising a first wall, said first wall having a first outer side located opposite a second inner side;

said housing having a second wall, said second wall having a third outer side located opposite a fourth inner side;

said housing having a third wall, said third wall having a fifth outer side located opposite a sixth inner side;

said first wall is connected to said second wall, said second wall is connected to said third wall, said first wall and said third wall of said housing are oriented in a parallel orientation forming a compartment;

said third wall comprising a spline groove and a protrusion, said spline groove is located on an outer side of said third wall, said protrusion located on an inner side of said third wall, whereby, said protrusion is located on an opposite side of said third wall having said spline groove of said housing, said protrusion having a radial end, said protrusion is angled at a range between 5 degrees and 85 degrees, said spline groove of said housing is oriented above said protrusion of said housing, said protrusion is configured to interlock with said spline groove of said extruded framing.

* * * * *